US009257124B2

(12) United States Patent
Beack et al.

(10) Patent No.: US 9,257,124 B2
(45) **Date of Patent: *Feb. 9, 2016**

(54) APPARATUS AND METHOD FOR CODING AND DECODING MULTI-OBJECT AUDIO SIGNAL WITH VARIOUS CHANNEL

(71) Applicant: Electronics and Telecommunications Research Institute, Daejon (KR)

(72) Inventors: Seung-Kwon Beack, Seoul (KR); Jeong-Il Seo, Daejon (KR); Tae-Jin Lee, Daejon (KR); Yong-Ju Lee, Daejon (KR); In-Seon Jang, Daejon (KR); Jae-Hyoun Yoo, Daejon (KR); Dae-Young Jang, Daejon (KR); Jin-Woo Hong, Daejon (KR); Jin-Woong Kim, Daejon (KR); Kyeong-Ok Kang, Daejon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/096,114

(22) Filed: Dec. 4, 2013

(65) Prior Publication Data

US 2014/0095178 A1 Apr. 3, 2014

Related U.S. Application Data

(63) Continuation of application No. 13/722,176, filed on Dec. 20, 2012, now Pat. No. 8,670,989, which is a continuation of application No. 12/443,644, filed as application No. PCT/KR2007/004795 on Oct. 1, 2007, now Pat. No. 8,364,497.

(30) Foreign Application Priority Data

Sep. 29, 2006 (KR) ..... 10-2006-0096172

(51) Int. Cl.
*G10L 19/00* (2013.01)
*G10L 19/008* (2013.01)
*G10L 19/20* (2013.01)

(52) U.S. Cl.
CPC ..... *G10L 19/00* (2013.01); *G10L 19/008* (2013.01); *G10L 19/20* (2013.01)

(58) Field of Classification Search
None
See application file for complete search history.

(56) References Cited

U.S. PATENT DOCUMENTS 7,508,947 B2 3/2009 Smithers
7,668,722 B2 2/2010 Villemoes et al.

(Continued)

FOREIGN PATENT DOCUMENTS

CN 1442956 A 9/2003
CN 1457482 A 11/2003

(Continued)

OTHER PUBLICATIONS

Notice of Allowance mailed Sep. 21, 2012 in corresponding U.S. Appl. No. 12/443,644.

(Continued)

*Primary Examiner* — Brian Albertalli
(74) *Attorney, Agent, or Firm* — Staas & Halsey LLP

(57) ABSTRACT

Provided are an apparatus and method for coding and decoding a multi-object audio signal. The apparatus includes a down-mixer for down-mixing the audio signals into one down-mixed audio signal and extracting supplementary information including header information and spatial cue information for each of the audio signals, a coder for coding the down-mixed audio signal, and a supplementary information coder for generating the supplementary information as a bit stream. The header information includes identification information for each of the audio signals and channel information for the audio signals.

5 Claims, 12 Drawing Sheets

(56) References Cited

U.S. PATENT DOCUMENTS

| | | | | |
|---|---|---|---|---|
| 7,680,288 | B2 | 3/2010 | Melchior et al. | |
| 7,756,713 | B2 | 7/2010 | Chong et al. | |
| 7,788,107 | B2 * | 8/2010 | Oh et al. | 704/500 |
| 7,987,097 | B2 * | 7/2011 | Pang et al. | 704/500 |
| 8,019,611 | B2 | 9/2011 | Oh et al. | |
| 8,081,762 | B2 | 12/2011 | Ojala et al. | |
| 8,214,221 | B2 * | 7/2012 | Pang et al. | 704/500 |
| 8,391,521 | B2 * | 3/2013 | Takumai | 381/307 |
| 2003/0167165 | A1 | 9/2003 | Schroder et al. | |
| 2005/0105442 | A1 | 5/2005 | Melchior et al. | |
| 2007/0206690 | A1 | 9/2007 | Sperschneider et al. | |
| 2008/0130904 | A1 | 6/2008 | Faller | |
| 2010/0106270 | A1 * | 4/2010 | Oh et al. | 700/94 |
| 2011/0022402 | A1 | 1/2011 | Engdegard et al. | |
| 2011/0144783 | A1 | 6/2011 | Reichelt et al. | |

FOREIGN PATENT DOCUMENTS

| | | | |
|---|---|---|---|
| CN | 1463429 | A | 12/2003 |
| CN | 1525438 | | 9/2004 |
| CN | 1787078 | | 6/2006 |
| JP | 9-503105 | | 3/1997 |
| JP | 2003-32800 | | 1/2003 |
| JP | 2003-66994 | | 3/2003 |
| JP | 2007-526520 | | 9/2007 |
| JP | 2007/531027 | | 11/2007 |
| JP | 2007/532960 | | 11/2007 |
| JP | 2008-512708 | | 4/2008 |
| JP | 2009-526467 | | 7/2009 |
| WO | 95/07579 | | 3/1995 |
| WO | 02/065449 | A1 | 8/2002 |
| WO | 02/101740 | A1 | 12/2002 |
| WO | 2004/036954 | A1 | 4/2004 |
| WO | 2005/013491 | A2 | 2/2005 |
| WO | 2005/094125 | | 10/2005 |
| WO | 2005/098824 | A1 | 10/2005 |
| WO | WO 2005/101370 | A1 | 10/2005 |
| WO | WO 2005/101371 | A1 | 10/2005 |
| WO | WO 2007/091870 | A1 | 8/2007 |

OTHER PUBLICATIONS

Jürgen Herrer, et al., "New Concepts in Parametric Coding of Spatial Audio: From SAC to SAOC", *Proceedings of the 2007 IEEE International Conference on Multimedia and Expo*, Jul. 2-5, 2007, pp. 1894-1897.

ISO/IEC International Standard 14496-3 Subpart 5: *MPEG-4 Structured Audio*, Second Edition, Dec. 15, 2001, pp. 16 and 27.

Christof Faller, "Parametric Joint-Coding of Audio Scources", *Proceedings of the Audio Engineering Society 120th Convention*, May 20-23, 2006, pp. 1-12.

J. Herre, et al., "The Reference Model Architecture for MPEG Spatial Audio Coding", *Audio Engineering Society 118th Convention*, May 28-31, 2005, pp. 1-13.

Christof Faller, et al., "Binaural Cue Coding: A Novel and Efficient Representation of Spatial Audio", *Proceedings of the IEEE International Conference on Acoustics, Speech and Signal Processing*, 2002, vol. 2, pp. II/1841-II/1844.

Korean Office Action issued Aug. 21, 2009 in corresponding Korean Patent Application 10-2007-0098663.

J. Breebaart et al., "MPEG Spatial Audio Coding/MPECG Surround Overview and Current Status", Audio Engineering Society Convention Paper (119th Convention), Oct. 7-10, 2005.

Christof Faller, "Parametric Coding of Spatial Audio", 2004.

Riitta Väänänen, "User Interaction and Authoring of 3 D Sounds Scenes in the Carrouso EU Project", Audio Engineering Society Convention Paper (114th Convention), Mar. 22-25, 2003.

Christof Faller, "Parametric Joint-Coding of Audio Sources", Audio Engineering Society 120th Convention, May 20-23, 2006, pp. 1-12.

Jürgen Herre et al,, "New Concepts in Parametric Coding of Spatial Audio: From SAC to SAOC", 2007 IEEE International Conference on Multimedia and Expo, IEEE, PI, Jul. 2-5, 2007, pp. 1894-1897.

Office Action mailed Apr. 22, 2013 in corresponding U.S. Appl. No. 13/722,176.

Notice of Allowance mailed Nov. 25, 2013 in corresponding U.S. Appl. No. 13/722,176.

U.S. Appl. No. 12/443,644, filed Mar. 5, 2010, Seung-Kwon Beack, Electronics and Telecommunications Research Institute.

U.S. Appl. No. 13/722,176, filed Dec. 20, 2012, Seung-Kwon Beack, Electronics and Telecommunications Research Institute.

U.S. Patent Office Action mailed Oct. 9, 2014 in co-pending U.S. Appl. No. 14/096,117.

U.S. Notice of Allowance mailed Mar. 11, 2015 in co-pending U.S. Appl. No. 14/096,117.

International Search Report and Written Opinion mailed Jan. 10, 2008 in corresponding International Application PCT/KR2007/004795.

International Report on Patentability mailed Feb. 10, 2009 in corresponding International Application PCT/KR2007/004795.

Notice of Allowance mailed Jun. 23, 2015 in corresponding U.S. Appl. No. 14/096,117.

Notice of Allowance mailed Dec. 16, 2015 in corresponding U.S. Appl. No. 14/096,117.

* cited by examiner

APPARATUS AND METHOD FOR CODING AND DECODING MULTI-OBJECT AUDIO SIGNAL WITH VARIOUS CHANNEL

CROSS REFERENCE TO RELATED APPLICATIONS

This application is a Continuation of U.S. Ser. No. 13/722,176, filed Dec. 20, 2012, which is a Continuation of U.S. Ser. No. 12/443,644, filed Mar. 5, 2010, which claims the benefit under 35 U.S.C. Section 371, of PCT International Application No. PCT/KR2007/004795, filed Oct. 1, 2007, which claimed priority to Korean Application No. 10-2006-0096172, filed Sep. 29, 2006, the disclosures of all of which are hereby incorporated by reference

TECHNICAL FIELD

The present invention relates to an apparatus and method for coding and decoding a multi-object audio signal; and, more particularly, to an apparatus and method for coding and decoding a multi-object audio signal having various channels and for coding and decoding a multi-object audio signal formed with various channels.

The multi-object audio signal having various channels is an audio signal including multiple audio objects each formed with different channels, for example, a mono channel, stereo channels, and 5.1 channels.

This work was partly supported by the Information Technology (IT) research and development program of the Korean Ministry of Information and Communication (MIC) and/or the Korean Institute for Information Technology Advancement (IITA) [2005-S-403-02, "super-intelligent multimedia anytime-anywhere realistic TV (SmaRTV) technology"].

BACKGROUND ART

An audio coding and decoding technology according to the related art enabled a user to passively listen to audio contents. Accordingly, there has been a demand of an apparatus and method for coding and decoding a plurality of audio objects constituted of different channels in order to enable a user to consume various audio objects by combining one audio-contexts using various methods through controlling each of audio objects constituted of different channels according to the user's needs.

As the related art, a spatial audio coding (SAC) was introduced. The SAC is a technology for expressing multi-channel audio signal as a down mixed mono signal or a down mixed stereo signal and a spatial cue, transmitting and restoring the multi-channel audio signal. Based on the SAC, high quality multi-channel audio signal can be transmitted at a low bit rate.

However, the SAC cannot code and decode multi-channel multi-object audio signal, for example, an audio signal including various objects each constituted of different channels such as mono, stereo, and 5.1 channels because the SAC is a technology for coding and decoding an single-object audio signal although the audio signal is constituted of multiple channels.

As another related art, a binaural cue coding (BCC) was introduced. The BCC can code and decode multi-object audio signal. However, the BCC cannot code and decode multi-object audio signal constituted of various channels except a mono channel because audio objects were limited to audio objects formed with a mono channel in the BCC.

As described above, the audio signal coding and decoding technology according to the related art cannot code and decode multi-object audio signal constituted of various channels because they was designed to code and decode multi-object signal constituted of a single channel or single-object audio signal with multi-channels. Therefore, a user must passively listen to audio context according to the audio signal coding and decoding technology according to the related art.

Therefore, there has been a demand of an apparatus and method for coding and decoding a plurality of audio objects constituted of various channels in order to consume various audio objects by mixing one audio-contents using various methods through controlling each of audio objects each having different channels according to the user's needs.

DISCLOSURE

Technical Problem

An embodiment of the present invention is directed to providing an apparatus and method for coding and decoding a multi-object audio signal having various channels and for coding and decoding multi-object audio signal constituted of various channels.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided an apparatus for coding multi-object audio signals having different channels, including: a down-mixing unit for down-mixing the audio signals into one down-mixed audio signal and extracting supplementary information including header information and spatial cue information for each of the audio signals; a coding unit for coding the down-mixed audio signal; and a supplementary information coding unit for generating the supplementary information as a bit stream, wherein the header information includes: identification information for each of the audio signals; and channel information for the audio signals.

In accordance with another aspect of the present invention, there is provided a method for coding multi-object audio signals having different channels, including the steps of: down-mixing the audio signals into one down-mixed audio signal and extracting supplementary information including header information and spatial cue information for each of the audio signals; coding the down-mixed audio signal; and generating the supplementary information as a bit stream, wherein the header information includes: identification information for each of the audio signals; and channel information for the audio signals.

In accordance with still another aspect of the present invention, there is provided an apparatus for decoding a multi-object audio signal constituted of different channels, including: an input signal analyzing unit for restoring a down-mixed audio signal from an inputted signal and extracting supplementary information having header information and spatial cue information from a supplementary information bit stream included in the inputted signal; an audio object extracting unit for restoring audio signals of each object from the restored down-mixed audio signal using the extracted supplementary information from the input signal analyzing unit; and an output unit for outputting the restored audio signals of each object as a multi-object audio signal using control information for the inputted signal, wherein the header information includes: identification information for each of the audio signals; and channel information for the audio signals.

In accordance with further another aspect of the present invention, there is provided a method for decoding a multi-object audio signal constituted of different channels, including the steps of: restoring a down-mixed audio signal from an inputted signal and extracting supplementary information having header information and spatial cue information from a supplementary information bit stream included in the inputted signal; restoring audio signals of each object from the restored down-mixed audio signal using the extracted supplementary information; and outputting the restored audio signals of each object as a multi-object audio signal using control information for the inputted signal, wherein the header information includes: identification information for each of the audio signals; and channel information for the audio signals.

In accordance with further still another aspect of the present invention, there is provided an apparatus for decoding a multi-object audio signal constituted of different channels, including: an input signal analyzing unit for restoring a down-mixed audio signal from an input signal and extracting supplementary information including header information and spatial cue information from a supplementary bit stream included in the input signal; a supplementary information control unit for controlling the extracted supplementary information using control information for the input signal; and an output unit for outputting the restored down-mixed audio signal as a multi-object audio signal using the controlled supplementary information, wherein the header information includes: identification information for each of the audio signals; and channel information for the audio signals.

In accordance with yet another aspect of the present invention, there is provided a method for decoding a multi-object audio signal constituted of different channels, including the steps of: restoring a down-mixed audio signal from an input signal and extracting supplementary information including header information and spatial cue information from a supplementary bit stream included in the input signal; controlling the extracted supplementary information using control information for the input signal; and outputting the restored down-mixed audio signal as a multi-object audio signal using the controlled supplementary information, wherein the header information includes: identification information for each of the audio signals; and channel information for the audio signals.

Advantageous Effects

An apparatus and method for coding and decoding a multi-object audio signal having various channels and for coding and decoding multi-object audio signal constituted of various channels according to an embodiment of the present invention enable a user to actively consume audio contents according to its needs by effectively coding and decoding audio contents including various audio objects constituted of different channels.

BEST MODE FOR THE INVENTION

The advantages, features and aspects of the invention will become apparent from the following description of the embodiments with reference to the accompanying drawings, which is set forth hereinafter.

Figure 1:
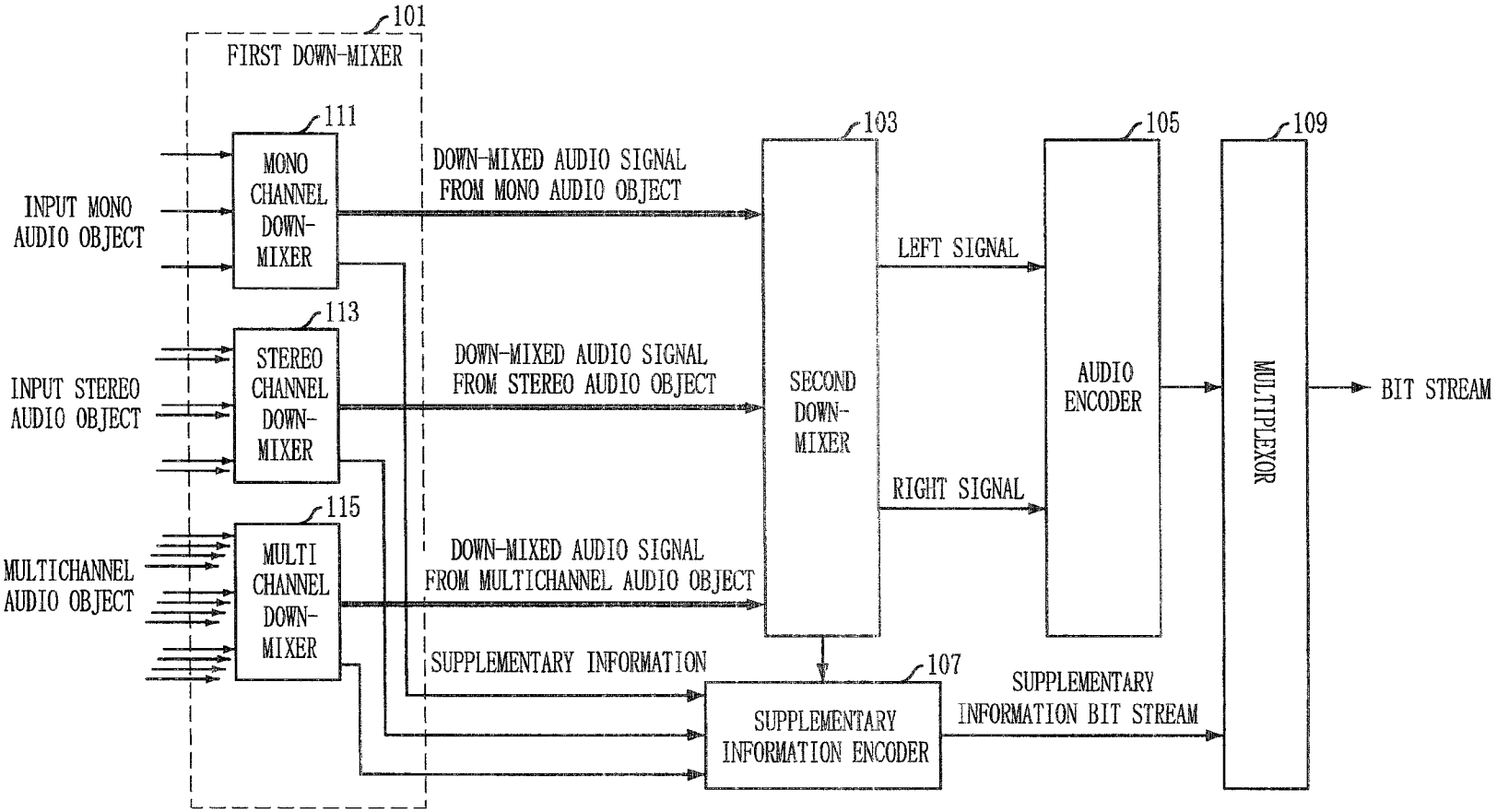
FIG. 1 is a diagram illustrating an apparatus for coding a multi-object audio signal in accordance with an embodiment of the present invention.

FIG. 1 is a diagram illustrating an apparatus for coding a multi-object audio signal in accordance with an embodiment of the present invention. For example, the apparatus according to the present embodiment receives multi-channel audio objects, for example, a mono channel audio object, a stereo channel audio objet, and a 5.1 channel audio object.

As shown in FIG. 1, the multi-object audio coding apparatus according to the present embodiment includes a first down mixer 101, a second down mixer 103, an audio encoder 105, and a supplementary information encoder 107, and a multiplexer 109.

The first down mixer 101 includes a mono channel down mixer 111, a stereo channel down mixer 113, and a multi-channel down mixer 115.

The first down mixer 101 identifies inputted various channel multi-object audio signal as a mono channel audio object, a stereo channel audio object, and a multi-channel audio signal using the header information of the inputted audio object. Then, the first down mixer 101 groups the identified audio signals by corresponding channels. Therefore, the different channels of multi-object audio signals are grouped by a channel, and the grouped audio objects are down-mixed by corresponding down mixers 111, 113, and 115.

The first down mixer 101 also extracts a down-mixed audio signal and supplementary information including a spatial cue from inputted audio objects. That is, sound sources are grouped by the same channel and inputted to the first down mixer 101. The mono channel down mixer 111 extracts a down mixed signal and supplementary information including a spatial cue from the mono audio object, and the stereo channel down mixer 113 extracts a down mixed signal and supplementary information including a spatial cue from the inputted stereo audio object. The multi-channel down mixer 115 extracts a down mixed signal and supplementary information having a spatial cue from the inputted multi-channel audio object, for example, 5.1 channels.

The audio encoder 105 codes a second down-mixed signal outputted from the second down mixer 103.

The supplementary encoder 107 generates a supplementary information bit stream using supplementary information outputted from the first down mixer 101 and supplementary information outputted from the second down mixer 103. Herein, the information included in the supplementary bit stream will be described with reference to FIG. 6.

The multiplexer 109 generates a bit stream to be transmitted to a decoding apparatus by multiplexing the coded signal from the audio encoder 105 and the supplementary bit stream generated from the supplementary encoder 107.

The first down mixed signal outputted from the first down mixer 101 is a stereo signal or a mono signal. That is, the down mixed signal outputted from the mono channel down mixer 111 is a mono signal, and the down mixed signals outputted from the remaining mixers 113 and 115 are a mono signal or a stereo signal.

The second down mixer 103 down-mixes the first down-mixed signal outputted from the first down mixer 101 and outputs the second down-mixed signal. The second down mixer 103 extracts supplementary information including a spatial cue, which is analyzed in the second down-mixing procedure. The second down-mixed signal is a mono signal or a stereo signal according to a mode.

The supplementary information includes header information for restoring and controlling a spatial cue and an audio signal. The supplementary information will be described with reference to FIG. 6.

Figure 2:
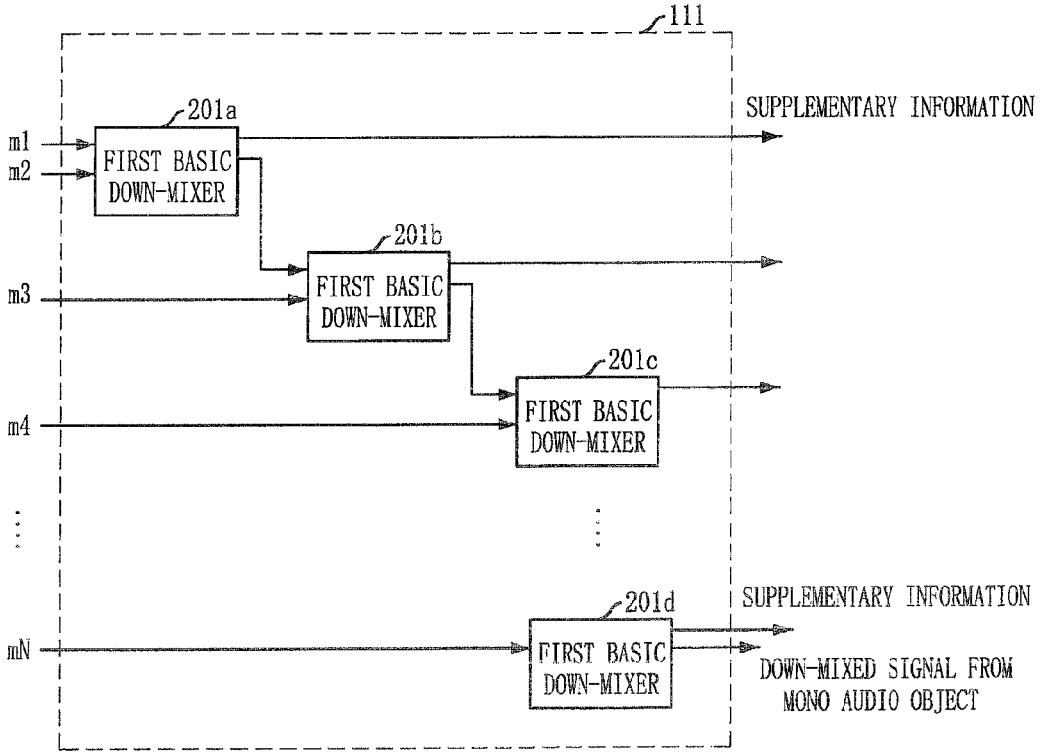
FIG. 2 is a diagram depicting a mono channel down mixer shown in FIG. 1.

FIG. 2 is a diagram depicting a mono channel down mixer shown in FIG. 1. For example, the mono channel down mixer 111 receives N mono audio objects m1 to mN.

As shown in FIG. 2, the mono channel down mixer 111 includes first basic down mixers 201*a* to 201*d* in a cascade structure.

The number of the first basic down mixers 201*a* to 201*b* included in the mono channel down mixer 111 is decided according to the number of the mono audio objects. That is, if the mono audio object is N, the number of the first basic down mixers 201 is N−1. If the mono audio object is 1, an input signal is bypassed without a basic down mixer.

In the present embodiment, one first basic down mixer can be used N−1 times based on a cascade method.

Basically, a first basic down mixer down-mixes two input signals, generates one down-mixed mono signal, and extracts supplementary information including a spatial cue for the input signal. The $1^{st}$ first basic down mixer 201*a* generates a down-mixed mono signal and extracts supplementary information including a spatial cue using two mono audio objects inputted to the mono channel down mixer 111. A $2^{nd}$ first basic down mixer 201*b* generates a down-mixed mono signal and extracts the supplementary information including a spatial cue using the down mixed mono signal outputted from the $1^{st}$ first basic down mixer 201*a* and a mono audio object inputted to the mono channel down mixer 111. A $(N-1)^{th}$ first basic down mixer generates a down-mixed mono signal and extracts supplementary information including a spatial cue using the down-mixed mono signal outputted from a $(N-2)^{th}$ basic down mixer (not shown) and a mono audio object inputted to the mono channel down mixer 111.

The spatial cue is information used for coding and decoding an audio signal. The spatial cue is extracted from a frequency domain and includes information about amplitude difference, delay difference, and correlativity between two signals inputted to the first basic down mixer 201. For example, spatial cue according to the present embodiment includes channel level difference (CLD), Inter-channel level difference (ICLD), Inter channel time difference (ICTD), Inter channel correlation (ICC), and virtual source location information between audio signals, denoting power gain information of an audio signal. However, the present invention is not limited thereto.

The supplementary information includes header information for restoring and controlling a spatial cue and an audio signal. The supplementary information will be described with reference to FIG. 6.

Figure 3:
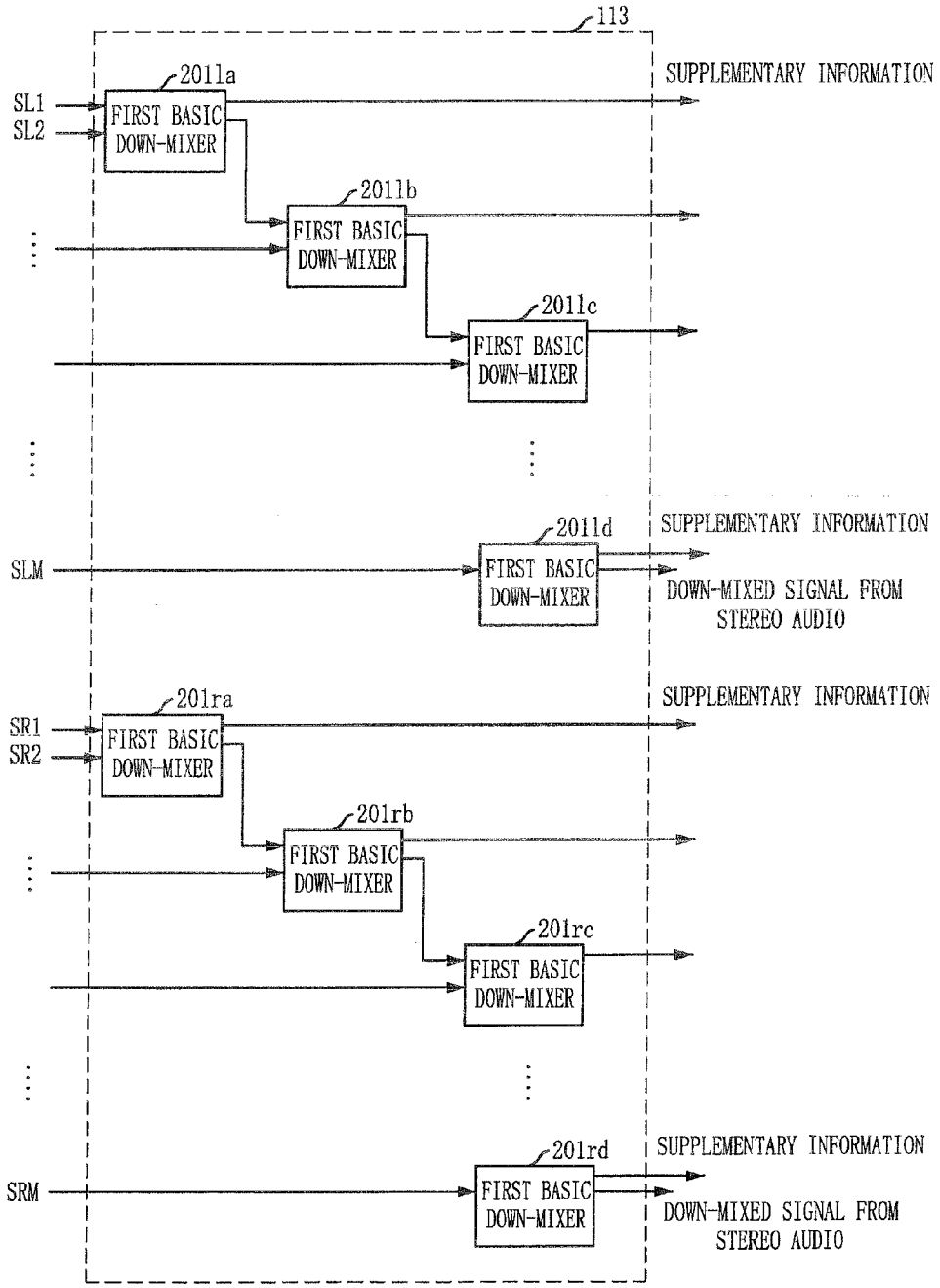
FIG. 3 is a diagram showing a stereo channel down mixer of FIG. 1.

FIG. 3 is a diagram showing a stereo channel down mixer of FIG. 1. For example, the stereo channel down mixer receives M left signals SL1 to SLM and M right signals SR1 to SRM as stereo audio objects.

The stereo audio object inputted to the stereo channel down mixer 113 is divided into a left stereo signal and a right stereo signal, and the divided signals are grouped again.

As shown in FIG. 3, the stereo channel down mixer 113 includes a plurality of first basic down mixers 201. The stereo channel down mixer 113 needs 2*(M−1) first basic down mixers 201 to down-mix M left signals and M right signals. Herein, one first basic down mixer may be used 2*(M−1) times in another embodiment.

As shown in FIG. 3, (M−1) first base down mixers 2011*a* to 2011*e* for analyzing M left signals generate one mixed left signal by analyzing inputted signals and extract supplementary information including a spatial cue.

As shown in FIG. 3, (M−1) first base down mixers 201*ra* to 201*re* for analyzing M right signals generate one mixed right signal by analyzing inputted signals and extract supplementary information including a spatial cue.

As shown in FIG. 3, is a stereo audio object is 1, an inputted left signal and right signal may be bypassed.

The stereo channel down mixer 113 outputs a stereo down mix signal and extracts supplementary information including a spatial cue by generating down mixed left signal and down mixed right signal.

The supplementary information includes header information for restoring and controlling a spatial cue and an audio signal. The supplementary information will be described with reference to FIG. 6.

Figure 4:
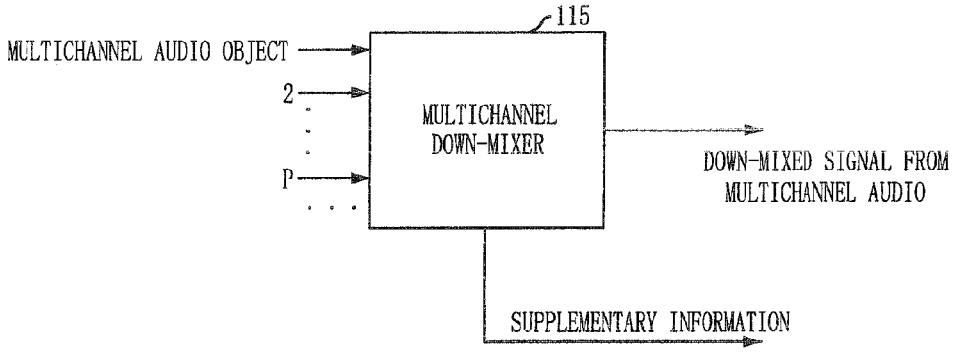
FIG. 4 is a diagram of a multi-channel down mixer of FIG. 1.

FIG. 4 is a diagram of a multi-channel down mixer of FIG. 1. For example, the multi-channel down mixer receives P 5.1 channel audio objects.

As shown in FIG. 4, the multi-channel down mixer 115 is a down mixer employing MPEG Surround or Spatial Audio coding (SAC). The multi-channel down mixer 115 extracts supplementary information including a spatial cue from a multi-channel audio signal and down-mixes the audio signal to a mono down mixed audio signal or a stereo down mixed audio signal.

That is, the multi-channel down mixer 115 extracts a spatial cue from P multi-channel audio objects and transmits the extracted spatial cue. The multi-channel down mixer 115 also down mixes the audio signal to a mono signal or a stereo signal. In general, the multi-channel audio object is one.

Figure 5:
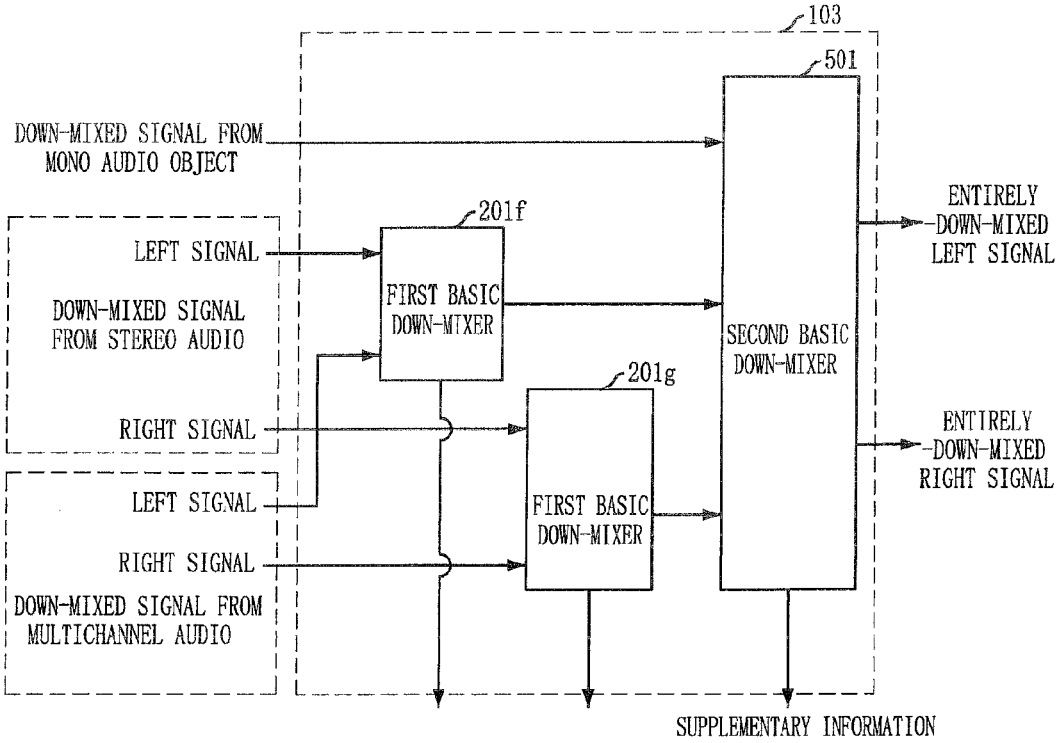
FIG. 5 is a diagram illustrating a second down mixer of FIG. 1.

FIG. 5 is a diagram illustrating a second down mixer of FIG. 1.

The second down mixer 103 down-mixes a signal outputted from the first down mixer 101 again, outputs a stereo down mix signal, and extracts supplementary information including a spatial cue.

As shown FIG. 5, the second down mixer 103 includes first basic down mixers 201*f* and 201*g* and a second basic down mixer 501.

If the down mixed signal from the stereo channel down mixer 113 and the multi-channel down mixer 115 is a stereo signal, corresponding down mixed stereo signals are grouped into a left signal and a right signal and the first basic down mixers 201*f* and 201*g* down mix the grouped left signal and the grouped right signal. The down mixed mono signals outputted from the first basic down mixers 201*f* and 201*g* are representative down mix signals of the left signal and the right signal.

That is, the first basic down mixer 201*f* down-mixes a left signal down mixed and outputted from the stereo channel down mixer 113 and a left signal down mixed and outputted from the multi-channel down mixer 115 again and outputs one down-mixed left signal as a representative left signal. Then, the first basic down mixer 201*f* extracts supplementary information.

The first basic down mixer 201*g* down-mixes a right signal down-mixed and outputted from the stereo channel down mixer 113 and a right signal down mixed and outputted from the multi-channel down mixer 115 again and outputs one representative right signal. Then, the first basic down mixer 201*g* extracts supplementary information.

As shown in FIG. 2, one first basic down mixer can be used twice according to another embodiment.

The second basic down mixer 501 down-mixes a down mixed mono signal outputted from the mono channel down mixer 111 and the left representative down mix signal and the right representative down mix signal outputted from the first basic down mixers 201*f* and 201*g* and outputs entire down mixed left signal and right signal. Then, the second basic down mixer 501 extracts supplementary information including a spatial cue.

The supplementary information includes header information for restoring and controlling a spatial cue and an audio signal. The supplementary information will be described with reference to FIG. 6 in later.

The first basic down mixer 201 and the second basic down mixer 501 down-mix an input audio signal based on following Equations Eq. 1 and Eq. 2.

$$[w_b^{11} \quad w_b^{12}]\begin{bmatrix} s_b^1(f) \\ s_b^2(f) \end{bmatrix} \qquad \text{Eq. 1}$$

$$\begin{bmatrix} w_b^{11} & w_b^{12} & w_b^{13} \\ w_b^{21} & w_b^{22} & w_b^{23} \end{bmatrix}\begin{bmatrix} s_b^1(f) \\ s_b^2(f) \\ s_b^3(f) \end{bmatrix} \qquad \text{Eq. 2}$$

In Eq. 1 and Eq. 2, $W_b^{ij}$ is a weighting factor for controlling a down-mixing level of an input audio signal. $s_b^j(f)$ is a mono signal or stereo left and right signals as an input audio signal of the first basic down mixer 201 and the second basic down mixer 501. A subscript b is an index denoting a sub band, and each weighting factor $w_b^{ij}$ is defined by a sub-band.

The weighting factor can be differently defined according to the expression purpose of an inputted audio object. For example, a weighting factor for $s_b^j(f)$ can be defined as a comparative large value in order to code a mono signal $s_b^j(f)$ as a main signal. If $w_b^{11}=0.7$, $w_b^{12}=0.3$ in Eq. 1, a down-mixed signal is $s_b^k(f)=0.7\ s_b^1(f)+0.3\ s_b^2(f)$. That is $s_b^1(f)$ is down-mixed as a main signal.

The weighting factor may be decided according to the constraint condition of an expression purpose for a down-mixed signal. The constraint condition is a constraint condition for sound scene. For example, the weighting factors of a violin and a guitar are set as 0.7 and 0.3 in order to play back audio signal of a violin and a guitar in a violin and guitar ratio of 0.7 to 0.3 from a down mixed audio signal. The constrain condition information is decided based on inputs from an external device such as a system or a user.

Meanwhile, the weighting factors must be reflected to spatial cue level information. For example, if the CLD is used as a spatial cue, spatial cue information can be predicted like Eq. 3 for Eq. 1.

$$\text{Level_defference_cue} = 10\log_{10}\left(\frac{P(w_b^{11}s_b^1)}{P(w_b^{12}s_b^2)}\right) \qquad \text{Eq. 3}$$

In Eq. 3, P( ) is a power operator, and a sum of signal power can be calculated using $$\sum_{b=A_b}^{A_{b+1}} |w_b s_b|^2.$$

$A_b$ and $A_{b+1}$ denote the boundary of a sub-band.

The second basic down mixer 501 extracts a spatial cue a Three-to-Two (TTT) box of MPEG Surround.

Figure 6:
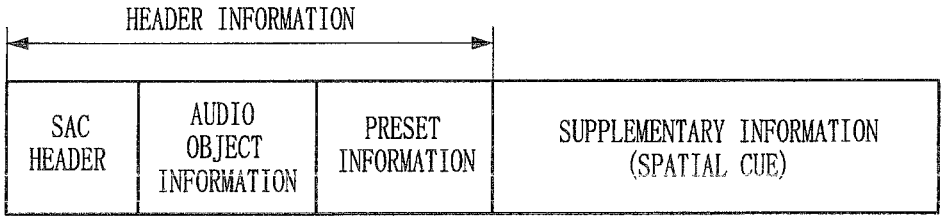
FIG. 6 is a diagram showing a structure of supplementary information bit stream which is generated from a supplementary information encoder of FIG. 1.

FIG. 6 is a diagram showing a structure of supplementary information bit stream which is generated from a supplementary information encoder of FIG. 1.

As shown in FIG. 6, the supplementary bit stream includes header information and a spatial cue.

The header information includes information for restoring and reproducing multi-object audio signal constituted of various channels. The header information also provides decoding information for mono, stereo, multi-channel audio objects by defining channel information for audio object and ID of a corresponding audio object. For example, a classification ID and information per objects may be defined to identify whether a coded predetermined audio object is a mono audio signal or a stereo audio signal. In an embodiment, the header information includes spatial audio coding (SAC) header information, audio object information, and preset information.

In an embodiment, the SAC header information is information generated in a procedure of coding an audio signal based on a spatial cue and time-slot information. The SAC header information is extracted by the first and second down mixers 101 and 103 when the first and second down mixers 101 and 103 extract supplementary information.

In an embodiment, the audio object information includes information and object ID information for identifying whether down mixed audio objects is mono, stereo or multi-channel audio object. For example, the audio object information includes information about the number of audio objects per each channel (a mono audio object number, a stereo audio object number, and a multi-channel audio object number) and the index information of audio objects per each channel, which includes ID and information whether an audio object is mono, stereo, and multi-channel.

In the present embodiment, the preset information is the supplementary information of header information and includes the defined control information of each object.

For example, the preset information includes preset mode information and preset mode support information. The preset mode information includes, for example, a karaoke mode, a solo object extraction mode such as extraction of guitar playing audio object and the extraction of piano playing audio object, preference rendering information, and playback mode setting information.

For example, the preset mode support information includes vocal index information for supporting a karaoke mode, corresponding object index information for supporting a solo object extraction mode, rendering information for each object such as rotation, elevation, and speed for supporting preference rendering, and optimal rendering information for each audio object for supporting basic stereo and multichannel playback mode setting.

Also, the spatial cue included in the supplementary information includes spatial cue information per each of objects of inputted multi-object audio signals.

The format of the supplementary information may be formed in various ways according to the selection of a designer.

Figure 7:
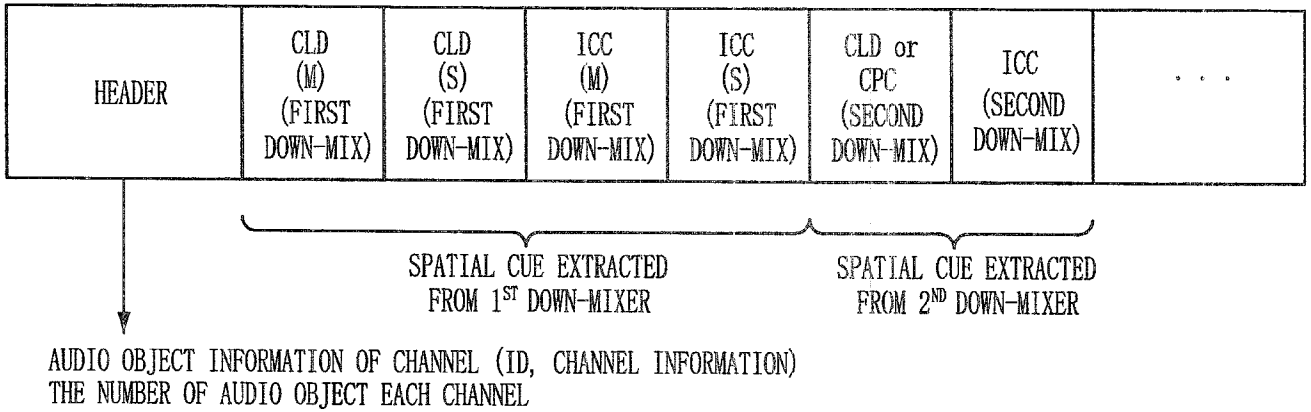
FIG. 7 is a detailed diagram illustrating the structure of supplementary information bit stream shown in FIG. 6.

FIG. 7 is a detailed diagram illustrating the structure of supplementary information bit stream shown in FIG. 6. That is, FIG. 7 shows supplementary information for a multi-object audio signal constituted of a mono and a stereo channel.

As shown in FIG. 7, the header information includes the information about the number of audio object per each channel such as the number of mono audio objects and the number of stereo audio objects. The header information also includes index information about audio objects per each channel including information about an ID and whether an audio object is mono, stereo, or multichannel. Also, the supplementary bit stream includes a spatial cue. As an example, CDL or ICC is used as an example of a spatial cue in the embodiment shown in FIG. 7.

As shown in FIG. 7, the supplementary information includes spatial cues such as CLD or ICC corresponding to each of mono and stereo objects. That is, the spatial cue information corresponding input audio object includes all supplementary information.

Figure 8:
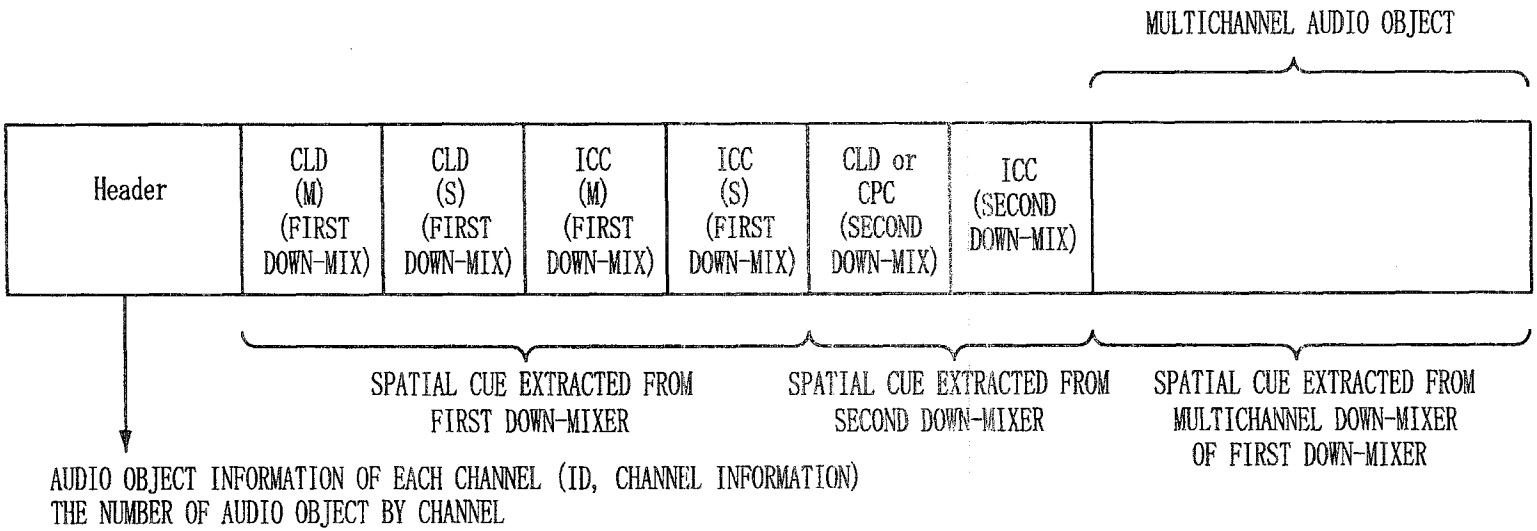
FIG. 8 is a detailed diagram illustrating a structure of supplementary information bit stream shown in FIG. 6 in accordance with another embodiment of the present invention.

FIG. 8 is a detailed diagram illustrating a structure of supplementary information bit stream shown in FIG. 6 in accordance with another embodiment of the present invention. That is, FIG. 8 shows supplementary information for multi-object audio signal constituted of mono, stereo, and multi-channel.

As shown in FIG. 8, the header information includes information about the number of audio objects per each channel such as the number of mono audio object, the number of stereo audio objects, and the number of multi-channel audio objects. The header information also includes index information of audio objects of each channel such as ID and whether an audio object is mono, stereo, or multichannel. Also, the supplementary bit stream includes a spatial cue. As an example of a spatial cue, a CLD and an ICC is used in the example of FIG. 8.

The spatial cue for a multi-channel object can be expressed as one supplementary bit stream by cascaded-multiplexing the spatial cue of the multi-channel object and spatial cues for mono and stereo objects. The spatial cue extracted by the mono channel down mixer 111, the stereo channel down mixer 113, and the second down mixer 103 is the spatial cue for the mono and stereo audio object of FIG. 8. Also, the spatial cue for multi-channel audio object of FIG. 8 is a spatial cue extracted by the multichannel down mixer 115.

Figure 9:
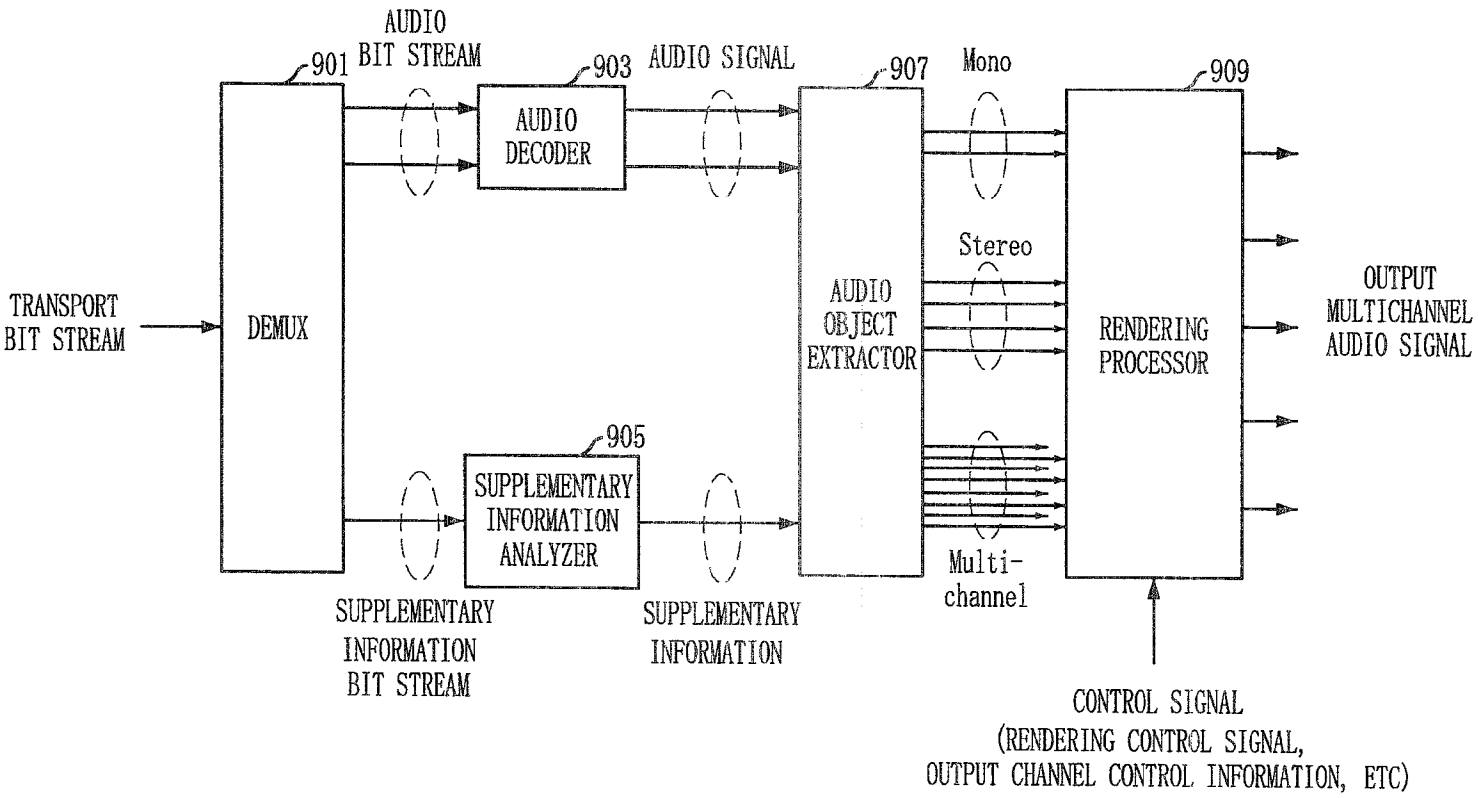
FIG. 9 is a block diagram illustrating an apparatus for decoding a multi-object audio signal in accordance with embodiment of the present invention.

FIG. 9 is a block diagram illustrating an apparatus for decoding a multi-object audio signal in accordance with embodiment of the present invention.

The multi-object audio signal decoding apparatus according to the present embodiment restores a multi-object audio signal constituted of various channels, which is an audio signal including a mono audio object, a stereo audio object, and a multi-channel audio object, by extracting spatial cue information from an audio bit stream generated from the multi-object audio signal coding apparatus shown in FIG. 1 and predicting each channel information using the extracted spatial cue.

As show in FIG. 9, the multi-object audio signal decoding apparatus according to the present embodiment includes a demultiplexer (DEMUX) 901, an audio decoder 903, a supplementary information analyzer 905, an audio object extractor 907, and a rendering processor 909.

For example, the demultiplexer 901 separates audio information bit stream and supplementary information bit stream from the audio bit stream generated from the multi-object audio signal coding apparatus of FIG. 1.

The audio decoder 903 restores a down mixed audio signal from the separated audio information bit stream from the demultiplexer 901.

The supplementary analyzer 905 extracts supplementary information including the spatial cue information of each audio object from the supplementary bit stream from the demultiplexer 901.

The audio object extractor 907 restores audio signals of each object from the down mixed audio signal using the header information of the extracted supplementary information from the supplementary information analyzer 905. Since the header information includes information about the number of audio objects of each channel such as the number of mono audio objects, the number of stereo audio objects, and the number of multi-channel audio objects and the index information of each audio object such as ID and whether an audio object is a mono audio object, a stereo audio object, and a multi-channel audio object, the audio object extractor 907 can restores audio signals of each object from the down mixed audio signal outputted from the audio decoder 903 based on the header information and the spatial cue information of the supplementary information extracted from the supplementary information analyzer 905.

The rendering processor 909 receives rendering control information such as locations and sizes of spatial audio objects and output channel control information such as 5.1 or 7.1 channel or stereo from an external device for each of the restored audio objects outputted from the audio object extractor 907. Based on the rendering control information and the output channel control information, the rendering processor 909 arranges the restored audio signals of each object and outputs the audio signal.

Figure 10:
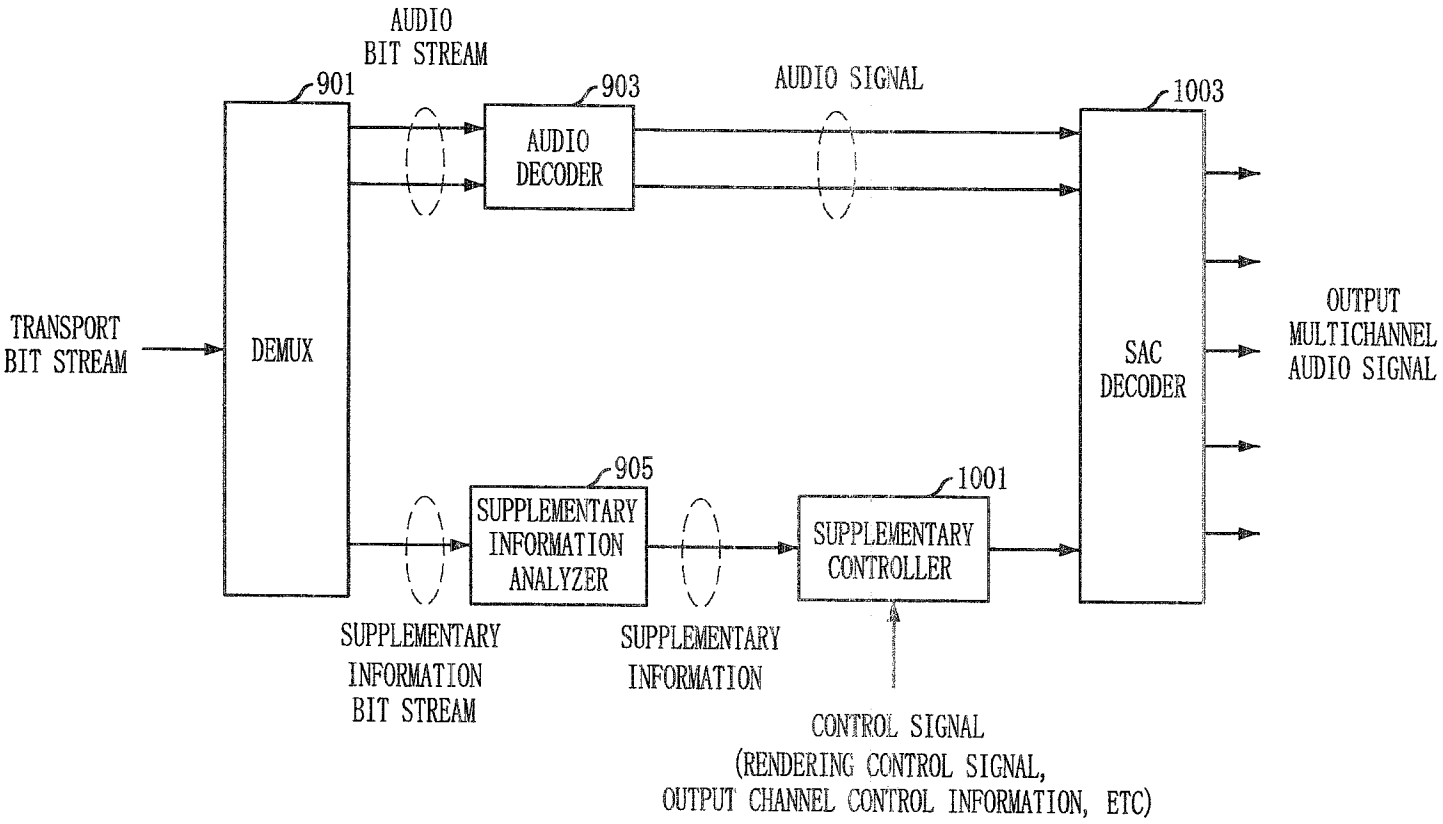
FIG. 10 is a block diagram illustrating an apparatus for decoding a multi-object audio signal in accordance with another embodiment of the present invention.

FIG. 10 is a block diagram illustrating an apparatus for decoding a multi-object audio signal in accordance with another embodiment of the present invention. Unlike the decoding apparatus of FIG. 9 that renders the audio signals restored according to each object, the multi-object audio signal decoding apparatus according to another embodiment shown in FIG. 10 restores an audio signal by controlling supplementary information and rendering audio objects according to the controlled supplementary information.

As shown in FIG. 10, the multi-object audio signal decoding apparatus according to another embodiment includes a demultiplexer 901, an audio decoder 903, a supplementary information analyzer 905, a supplementary information controller 1001, and a SAC decoder 1003.

The demultiplexer 901, the audio decoder 903, and the supplementary information analyzer 905 of FIG. 10 are identical to the demultiplexer 901, the audio decoder, and the supplementary information analyzer 905 of FIG. 9.

The supplementary information controller 1001 receiving rendering control information such as the locations and the sizes of spatial audio objects and output channel control information such as 5.1 or 7.1 channel and stereo from an external device for the restored down mixed audio signal from the audio decoder 903 and controls the extracted supplementary information such as the signal amplitude of each audio object and correlativity information from the supplementary information analyzer 905 according to the external input signal.

The SAC decoder 1003 restores multi-channel multi-object audio signal from the down mixed audio signal restored from the audio decoder 903 using the controlled supplementary information from the supplementary information controller 1001. The SAC decoder 1003 restores audio signals of each object from the down mixed audio signal using the header information of the controlled supplementary information from the supplementary information controller 1001. Since the header information includes information about the number of audio objects of each channel such as the number of mono audio objects, the number of stereo audio objects, and the number of multi-channel audio objects and the index information of each audio object such as ID and whether an audio object is a mono audio object, a stereo audio object, and a multi-channel audio object, the SAC decoder 103 can restore audio signals of each object from the down mixed audio signal outputted from the audio decoder 903 based on the header information and the spatial cue information of the supplementary information controlled from the supplementary information controller 1001.

Figure 11:
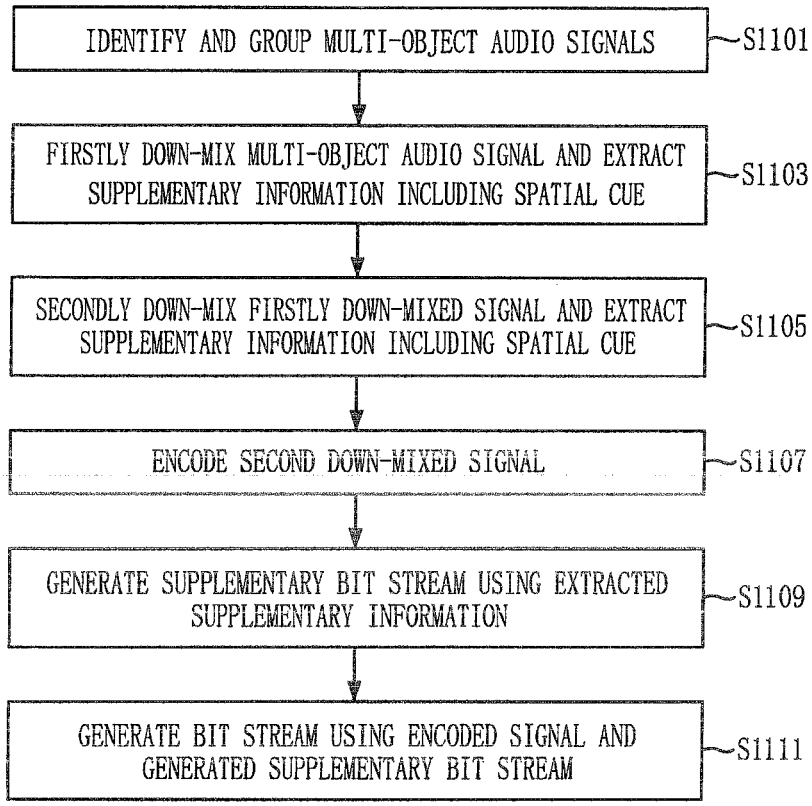
FIG. 11 is a flowchart of a method for coding a multi-object audio signal using the apparatus of FIG. 1 in accordance with an embodiment of the present invention.

FIG. 11 is a flowchart of a method for coding a multi-object audio signal using the apparatus of FIG. 1 in accordance with an embodiment of the present invention.

Referring to FIG. 11, inputted multi-object audio signals of various channels are classified into a mono audio signal, a stereo audio signal, and a multi-channel audio signal and grouped by each channel based on the header information of the input audio object at step S1101.

At step S1103, the sound source grouped by the same channel is down mixed, and supplementary information including a spatial cue is extracted. That is, a down mixed signal and supplementary information including a spatial cue are extracted from inputted mono audio object, a down mixed signal and supplementary information including a spatial cue are extracted from inputted stereo audio object, and a down mixed signal and supplementary information including a spatial cue are extracted from inputted multi-channel audio object, for example, 5.1 channel.

The first down mixed signal outputted at the step S1103 is a stereo signal or a mono signal. That is, the down mixed signal outputted from the inputted mono audio object is a mono signal, and the down mixed signal outputted from the inputted stereo audio object or the inputted multi-channel audio object is a mono signal or a stereo signal.

Then, the first down mixed signal is down mixed again, and supplementary information including a spatial cue is extracted at step S1105. Herein, the second down mixed signal may be a mono signal or a stereo signal according to a mode.

Then, the second down mixed signal outputted at the step S1105 is coded at step S1107.

At step S1109, a supplementary information bit stream is generated using supplementary information outputted at the step S1103 and the supplementary information outputted at the step S1105.

At step S1111, a bit stream to be transmitted to a decoding apparatus is generated by multiplexing the generated supplementary information bit streams from the step S1107.

Figure 12:
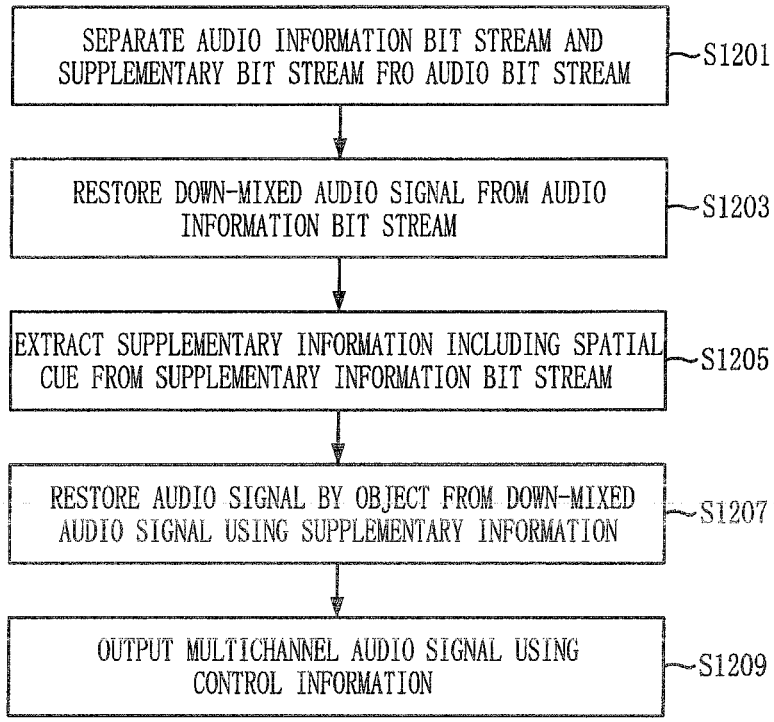
FIG. 12 is a flowchart of a method for decoding a multi-object audio signal using the apparatus of FIG. 9 in accordance with an embodiment of the present invention.

FIG. 12 is a flowchart of a method for decoding a multi-object audio signal using the apparatus of FIG. 9 in accordance with an embodiment of the present invention.

Referring to FIG. 12, an audio information bit stream and a supplementary information bit stream are separated from the audio bit stream generated from the step S1111 at step S1201.

At step S1203, a down mixed audio signal is restored from the separated audio information bit stream.

At step S1205, supplementary information including spatial cue information of each audio object is extracted from the separated bit stream.

At step S1207, audio signals of each object are restored from the down mixed audio signal using the header information of the extracted supplementary information. Since the header information includes information about the number of audio objects of each channel such as the number of mono audio objects, the number of stereo audio objects, and the number of multi-channel audio objects and the index information of each audio object such as ID and whether an audio object is a mono audio object, a stereo audio object, and a multi-channel audio object, the audio signals of each object can be restored from the down mixed audio signal outputted at the step S1203 based on the header information and the spatial cue information of the extracted supplementary information extracted at the step S1205.

At step S1207, rendering control information for each of the restored audio object, for example, the locations and sizes of spatial audio objects, and output channel control information, for example, 5.1 or 7.1 channel or stereo, are received from an external device, and audio signals of each of the restored objects are arranged, and a multi-object audio signal is outputted.

Figure 13:
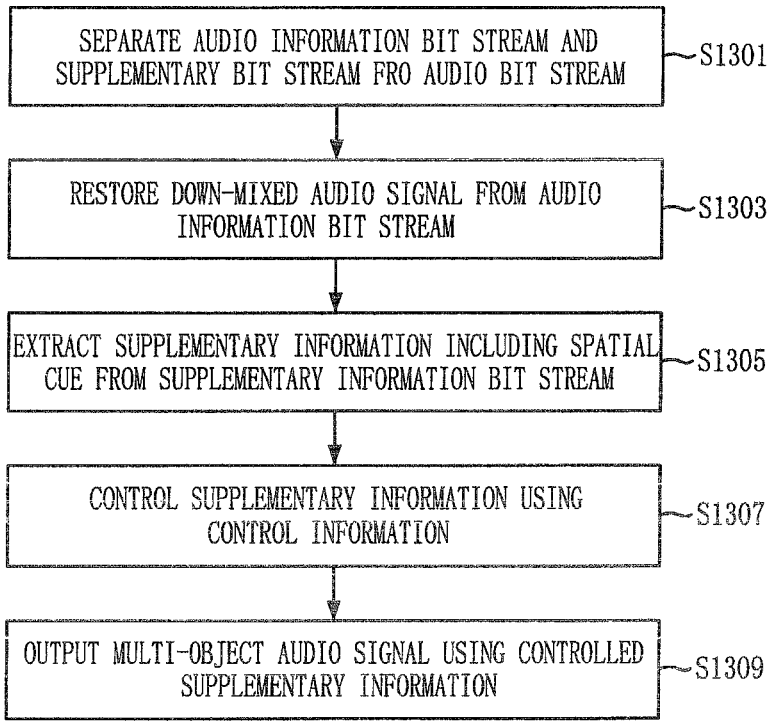
FIG. 13 is a flowchart of a method for decoding a multi-object audio signal using the apparatus of FIG. 10 in accordance with another embodiment of the present invention.

FIG. 13 is a flowchart of a method for decoding a multi-object audio signal using the apparatus of FIG. 10 in accordance with another embodiment of the present invention.

At step S1301, an audio information bit stream and a supplementary information bit stream are separated from the generated audio bit stream from the step S1111.

At step S1303, a down mixed audio signal is restored from the separated audio information bit stream.

At step S1305, supplementary information including spatial cue information of each audio object is extracted from the separated supplementary bit stream.

At step S1307, rendering control information for each of the restored audio objects, for example, the locations and the sizes of spatial audio objects, and output channel control information, for example, 5.1 or 7.1 channel and stereo, are received from an external device, and the supplementary information extracted from the step S1305 is controlled according to the external input signal, where the extracted supplementary information, for example, includes information about signal amplitude of each audio object and correlativity information.

At step S1309, multi-object audio signals of various channels are restored from the down mixed audio signals from the step S1303 using the controlled supplementary information. Audio signals of each object are restored from the down mixed audio signals using the header information of the controlled supplementary information. Since the header information includes information about the number of audio objects of each channel such as the number of mono audio objects, the number of stereo audio objects, and the number of multi-channel audio objects and the index information of each audio object such as ID and whether an audio object is a mono audio object, a stereo audio object, and a multi-channel audio object, the audio signals of each object can be restored from the down mixed audio signals outputted from the step S1303 based on the header information and the spatial cue information of the controlled supplementary information from the step S1307.

The above described method according to the present invention can be embodied as a program and stored on a computer readable recording medium. The computer readable recording medium is any data storage device that can store data which can be thereafter read by the computer system. The computer readable recording medium includes a read-only memory (ROM), a random-access memory (RAM), a CD-ROM, a floppy disk, a hard disk and an optical magnetic disk.

While the present invention has been described with respect to certain preferred embodiments, it will be apparent to those skilled in the art that various changes and modifications may be made without departing from the spirits and scope of the invention as defined in the following claims.

INDUSTRIAL APPLICABILITY

An apparatus and method for coding and decoding a multi-object audio signal according to an embodiment of the present invention enable a user to actively consume audio contents according to needs by effectively coding and decoding the audio contents of various objects constituted of various channels.

What is claimed is:

1. An apparatus for decoding multi-object audio signals having different channels, comprising:

a supplementary information controller to control supplementary information extracted from an input signal, using control information to restore a downmix audio signal from the input signal, wherein the control information includes rendering control information for the restored downmix audio signal; and an output unit to output the restored downmix audio signal as a multi-channel audio signal, using the supplementary information controlled by the supplementary information controller, wherein the supplementary information includes preset user listening information for the multi-object audio signals.

2. The apparatus of claim 1, wherein the preset user listening information includes:

preset mode information for defining a preset mode for the multi-object audio signals; and preset mode support information for defining information required for supporting the preset mode.

3. The apparatus of claim 1, wherein the supplementary information further includes:

identification information for each of the multi-object audio signals; and channel information for the multi-object audio signals.

4. An apparatus for decoding multi-object audio signals having different channels, comprising:

a supplementary information controller to control supplementary information extracted from an input signal, using control information to restore downmix audio signal from the input signal, wherein the control information includes rendering control information for the restored downmix audio signal; and an output unit to output the restored downmix audio signal as a multi-channel audio signal, using the supplementary information controlled by the supplementary information controller, wherein the supplementary information includes preset information for the multi-object audio signals, identification information for each of the multi-object audio signals, and channel information for the audio signals wherein the channel information includes:

channel information for each of the multi-object audio signals; and information of a number of audio objects for each channel of the multi-object audio signals.

5. An apparatus for decoding multi-object audio signals having different channels, comprising:

a supplementary information controller to control supplementary information extracted from an input signal, using control information to restore downmix audio signal from the input signal, wherein the control information includes rendering control information for the restored downmix audio signal; and an output unit to output the restored downmix audio signal as a multi-channel audio signal, using the supplementary information controlled by the supplementary information controller, wherein the supplementary information includes preset information for the multi-object audio signals, and spatial cue information for an audio object of one of a mono channel, a stereo channel, and a multi-channel of the multi-object audio signal.

* * * * *